US008925911B2

(12) United States Patent
Nozaki

(10) Patent No.: US 8,925,911 B2
(45) Date of Patent: Jan. 6, 2015

(54) SHEET FEEDING DEVICE AND IMAGE FORMING SYSTEM

(71) Applicant: Mitsuhiro Nozaki, Nagoya (JP)

(72) Inventor: Mitsuhiro Nozaki, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/849,352

(22) Filed: Mar. 22, 2013

(65) Prior Publication Data

US 2014/0125003 A1 May 8, 2014

(30) Foreign Application Priority Data

Sep. 27, 2012 (JP) ..... 2012-214210

(51) Int. Cl.

| | |
|---|---|
| ***B65H 5/06*** | (2006.01) |
| ***B65H 9/04*** | (2006.01) |
| ***B65H 9/00*** | (2006.01) |
| ***B65H 3/06*** | (2006.01) |
| ***B65H 7/06*** | (2006.01) |

(52) U.S. Cl.

CPC ..... *B65H 9/002* (2013.01); *B65H 3/0669* (2013.01); *B65H 7/06* (2013.01); *B65H 9/004* (2013.01)

USPC ..... 271/10.03; 271/265.01; 271/242

(58) Field of Classification Search

CPC ..... B65H 9/004; B65H 9/006; B65H 9/008

USPC ..... 271/10.03, 10.11, 242, 266, 265.01, 271/10.01

See application file for complete search history.

(56) References Cited

U.S. PATENT DOCUMENTS

| | | | | |
|---|---|---|---|---|
| 5,112,038 | A * | 5/1992 | Dunaway | 271/10.03 |
| 6,805,342 | B2 * | 10/2004 | Takahara et al. | 271/19 |
| 7,334,787 | B2 * | 2/2008 | Akiyama et al. | 271/10.02 |
| 7,673,870 | B2 * | 3/2010 | Koga et al. | 271/10.11 |
| 7,686,301 | B2 * | 3/2010 | Kakishima | 271/264 |
| 8,107,873 | B2 * | 1/2012 | Nakazawa et al. | 399/394 |
| 8,413,983 | B2 * | 4/2013 | Hirano | 271/258.01 |
| 8,590,884 | B2 * | 11/2013 | Maruta et al. | 271/10.03 |
| 2007/0076036 | A1 | 4/2007 | Koga et al. | |
| 2008/0006982 | A1 * | 1/2008 | Kakishima et al. | 271/10.03 |
| 2012/0319345 | A1 | 12/2012 | Asada et al. | |

FOREIGN PATENT DOCUMENTS

| | | | |
|---|---|---|---|
| JP | 2001-253595 | A | 9/2001 |
| JP | 2005-154100 | A | 6/2005 |
| JP | 2007-090800 | A | 4/2007 |
| JP | 2013-000966 | A | 1/2013 |

* cited by examiner

*Primary Examiner* — Luis A Gonzalez
(74) *Attorney, Agent, or Firm* — Merchant & Gould PC

(57) ABSTRACT

A sheet feeding device includes: a feeding mechanism having a first roller and a second roller provided downstream in a sheet feeding path from the first roller and feeding a sheet by rotations of the first and second rollers; a control section executing a butting control by controlling the first and second rollers to feed the sheet from the first roller so as to butt against the second roller at an intake position, and executing an intake feeding control by controlling the second roller to feed the sheet downstream in the feeding path from the intake position; an obtaining section obtaining information indicating a rotation amount of the second roller in a period after the butting control to the start of the intake feeding control; and a target setting section setting a target rotation amount of the second roller that should be achieved in the intake feeding control.

12 Claims, 11 Drawing Sheets

SHEET FEEDING DEVICE AND IMAGE FORMING SYSTEM

CROSS REFERENCE TO RELATED APPLICATION

The present invention claims priority from Japanese Patent Application No. 2012-214210, filed on Sep. 27, 2012, the disclosure of which is incorporated herein by reference in its entirety.

BACKGROUND OF THE INVENTION

1. Field of the Invention

The present invention relates to a sheet feeding device and an image forming system.

2. Description of the Related Art

As an image forming system, there has been known an ink-jet printer in which when sheets stacked in a tray are separated one by one by a paper feeding roller to be fed to an image forming position, the sheet is fed so as to butt against a resist roller pair disposed upstream from the image forming position, or the like. In this image forming system, the sheet is bent by the above-described butting, to thereby perform skew correction of the sheet. The skew correction is performed in a state of the resist roller pair being stopped, or in a state of the resist roller pair being made to rotate in a direction reverse to a sheet feeding direction, for example.

Besides, as the image forming system, there has been known a system in which a paper feeding roller and a resist roller are driven by a common single motor.

SUMMARY OF THE INVENTION

According to the above-described image forming system, however, at the time of the skew correction, the resist roller pair is held in a state of being stopped, or is made to rotate in a direction reverse to the sheet feeding direction. On the other hand, after the skew correction, it is necessary to make the resist roller pair rotate in a forward direction for sheet feeding. For this reason, in the case that the paper feeding roller and the resist roller are driven by a single motor, it is necessary to switch a rotation direction of the motor and a power transmission system from the motor to the respective rollers before and after the skew correction. However, in a system associated with such switching, at the time of switching, the resist roller pair rotates naturally and a displacement of a sheet position is caused because the balance of force is lost, and the like.

Further, in the case that the resist roller pair is driven by a motor different from that for the paper feeding roller, as well, on the resist roller pair, a force in a direction to eliminate the bending of the sheet generated by the above-described butting acts. For this reason, due to the action of the force, when the sheet feeding by the resist roller pair is started after the skew correction, the resist roller pair rotates naturally. Then, by this rotation, the displacement of the sheet position is caused, and this positional displacement causes an error in the sheet feeding later.

The present invention has been made in consideration of such problems, and has an object to provide a technique capable of feeding a sheet to a predetermined position highly accurately by motor control while suppressing an effect of rotation of the roller that does not derive from driving of a motor, when the butted sheet is taken in by rotation of the roller and is fed to the predetermined position on a downstream side of a sheet feeding path.

A sheet feeding device according to an aspect of the present invention includes: a feeding mechanism; a control section; an obtaining section; and a target setting section. The feeding mechanism includes first and second rollers and feeds a sheet by rotations of the first and second rollers. The second roller is disposed downstream in a sheet feeding path from the first roller.

The control section controls the rotations of the first and second rollers to thereby perform a feeding control of the sheet. Concretely, the control section executes a butting control and then executes an intake feeding control. The butting control is a control in which the first roller is made to rotate forwardly in a state of the second roller being made to rotate reversely, to thereby feed the sheet from the first roller so as to butt against the second roller at an intake position of the second roller. The butting control may also be one in which the first roller is made to rotate forwardly in a state of the second roller being stopped. The intake feeding control is a control in which the second roller is made to rotate forwardly, to thereby feed the sheet downstream in the sheet feeding path from the above-described intake position.

The obtaining section obtains information indicating a rotation amount of the second roller by a rotation phenomenon of the second roller which occurs in a period after the butting control to the start of the intake feeding control. The target setting section sets a target rotation amount, which is a rotation amount of the second roller that should be achieved in the intake feeding control, to an amount corrected from a standard target rotation amount for the rotation amount indicated by the information obtained by the obtaining section.

Then, the control section executes the above-described intake feeding control based on the rotation amount. That is, the control section control the second roller to stop the rotation of the second roller at a timing at which the second roller has rotated for the target rotation amount since the start of the intake feeding control, so that stop the sheet stops at a position at which the sheet has been fed downstream in the sheet feeding path from the intake position only for a distance corresponding to the standard target rotation amount.

As described above, according to the sheet feeding device of the present invention, when the sheet butted against the second roller is fed to the downstream position (the position where the sheet has been fed downstream in the sheet feeding path from the intake position for the distance corresponding to the standard target rotation amount) by the rotation of the second roller, the target rotation amount corrected based on the above-described rotation amount is set as an index, and a rotation control of the roller is performed.

For this reason, according to the present invention, it is possible to suppress an effect of a positional displacement caused by natural rotation of the second roller that occurs in the above-described period and does not derive from driving of a motor, and to feed the sheet to a predetermined position highly accurately. Thus, according to the present invention, it is possible to provide the high-performance sheet feeding device.

DETAILED DESCRIPTION OF THE PREFERRED EMBODIMENTS

Figure 1:
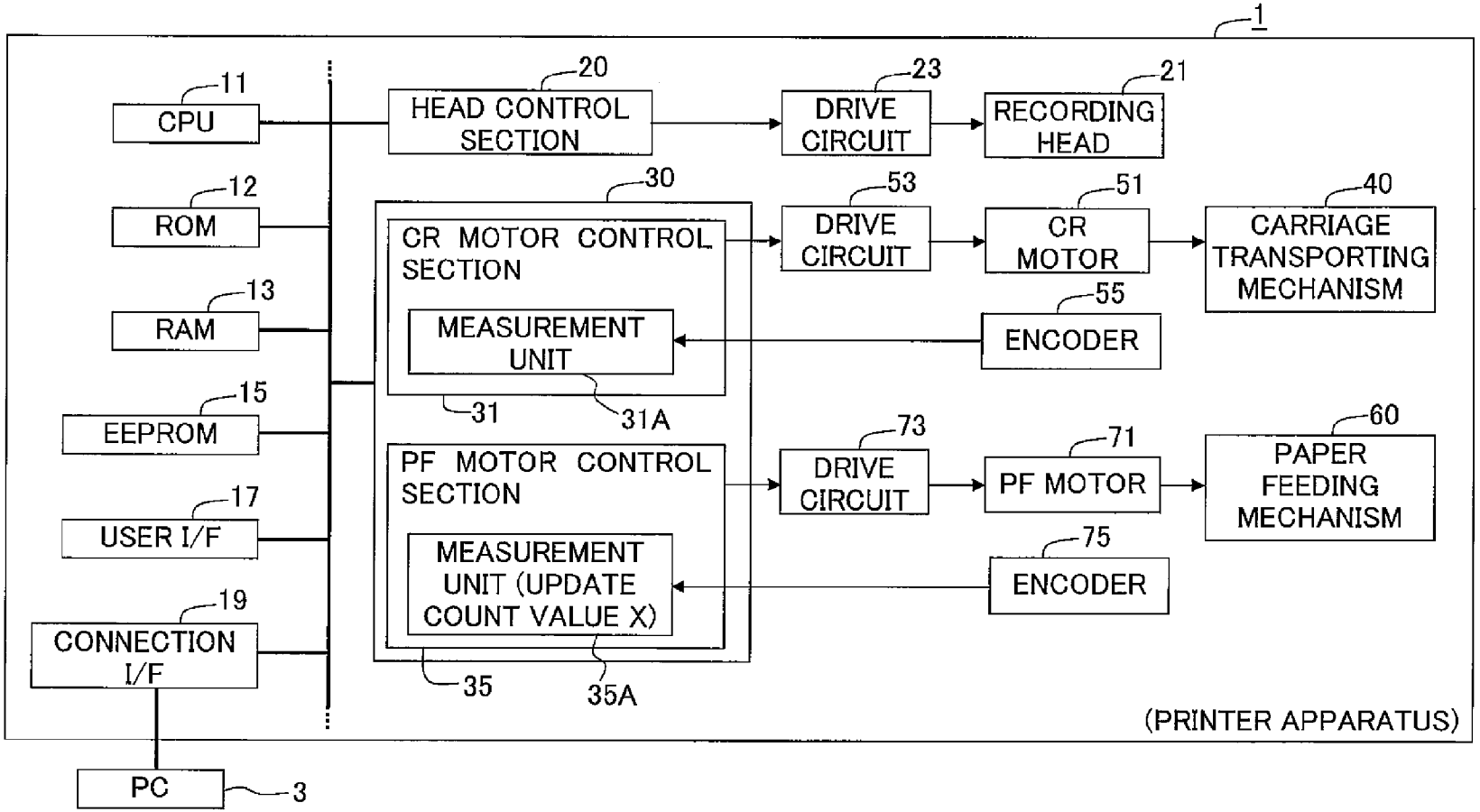
FIG. 1 is a block diagram showing a configuration of a printer apparatus.

Hereinafter, embodiments of the present invention will be explained with reference to the drawings. A printer apparatus 1 in this embodiment is a printer apparatus that has a skew correction function for a paper Q and forms an image on the skew-corrected paper Q by an ink-jet method (what is called an ink-jet printer). This printer apparatus 1 includes: a CPU 11; a ROM 12; a RAM 13; an EEPROM 15; a user interface 17; a connection interface 19; a head control section 20; and a motor control section 30, as shown in FIG. 1.

Further, this printer apparatus 1 includes: a recording head 21; and a drive circuit 23 as a constitution for forming an image on the paper Q. Further, the printer apparatus 1 includes: a carriage transporting mechanism 40; a CR motor 51; a drive circuit 53; and a linear encoder 55 as a constitution for feeding the recording head 21 in a primary scanning direction. The linear encoder 55 is a mechanism for measuring a position and a speed of a carriage 41 having the recording head 21 mounted thereon.

Besides, the printer apparatus 1 includes: a paper feeding mechanism 60; a PF motor 71; a drive circuit 73; and a rotary encoder 75 as a constitution for feeding the paper Q in a secondary scanning direction perpendicular to the primary scanning direction. The rotary encoder 75 is a mechanism for measuring a rotation amount and a rotation speed of a transporting roller 64 (see FIG. 2, its detail will be described later) that the paper feeding mechanism 60 includes.

More specifically, the CPU 11 executes processings in accordance with programs recorded in the ROM 12 to thereby control the printer apparatus 1 integrally and achieve various functions. The ROM 12 stores various programs therein. The RAM 13 is used as a working memory at the time when processing is executed by the CPU 11. The EEPROM 15 stores setting information and the like therein as a nonvolatile memory capable of electrically rewriting data.

The user interface 17 includes: a display for displaying various pieces of information for a user using the printer apparatus 1; and an operation device for accepting various pieces of operation information to the printer apparatus 1 from a user. The connection interface 19 is an interface (for example, a USB interface) for connecting a personal computer (PC) 3 and the printer apparatus 1, and is configured to be able to receive a print instruction and print target data from the PC 3.

The CPU 11, when receiving the print instruction and the print target data from the PC 3 through the connection interface 19, executes later-described printing control processing to input an instruction to the head control section 20 and the motor control section 30. This thereby makes the head control section 20 execute jetting control of ink droplets from the recording head 21 and makes the motor control section 30 execute transporting controls of the carriage 41 and the paper Q by controls of the CR motor 51 and the PF motor 71. By these controls, an image based on the above-described print target data is formed on the paper Q.

The recording head 21 is a well-known ink-jet head having a plurality of nozzles for jetting ink droplets arranged thereon. This recording head 21 is driven by the drive circuit 23 to jet ink droplets onto an area of the paper Q facing a nozzle surface.

The head control section 20, based on the instruction from the CPU 11, inputs a control signal to the drive circuit 23 so that the image based on the print target data may be formed on the paper Q. The head control section 20 achieves the jetting control of ink droplets by the input of the above-described control signal.

On the other hand, the carriage transporting mechanism 40 is driven by the CR motor 51 to move the carriage 41 having the recording head 21 mounted thereon in the primary scanning direction. The carriage transporting mechanism 40, similarly to a well-known carriage transporting mechanism, has a constitution in which the carriage 41 is placed on guide rails 45 and 47 extending in the primary scanning direction (a paper normal direction in FIG. 2). Further, the carriage 41 is coupled to a belt 43.

The carriage 41 includes grooves 41A and 41B extending in the primary scanning direction in its bottom surface portion and is placed on the guide rails 45 and 47 in a manner that the guide rails 45 and 47 are inserted in the grooves 41A and 41B. By this placement, the movement of the carriage 41 is limited to the primary scanning direction. The carriage 41 receives operation of power from the belt 43 in a state of the movement being limited as above, to thereby reciprocate in the primary scanning direction (paper normal direction in FIG. 2). The belt 43 is driven by the CR motor 51.

Further, the carriage 41 includes a groove 41C in the primary scanning direction corresponding to the shape of an encoder scale 55A in its top surface portion. In the groove 41C, an optical sensor 55B capable of reading the encoder scale 55A is fixedly disposed. The above-described linear encoder 55 includes the encoder scale 55A and the optical sensor 55B inserted in this groove 41C.

The linear encoder 55 utilizes a phenomenon in which a relative position of the optical sensor 55B relative to the encoder scale 55A changes with the carriage 41 moving in the primary scanning direction. This linear encoder 55 reads a scale of the encoder scale 55A by the optical sensor 55B to output a pulse signal corresponding to a displacement, of the carriage 41, in the primary scanning direction to a later-described measurement unit 31A as an encoder signal.

Besides, the motor control section 30 (see FIG. 1) includes a CR motor control section 31 that controls the CR motor 51 to perform the transporting control, of the carriage 41, in the primary scanning direction. The CR motor control section 31, in accordance with the instruction from the CPU 11, generates a pulse width modulation (PWM) signal as an input signal to the drive circuit 53 and controls the CR motor 51 composed a direct-current motor. The drive circuit 53 drives the CR motor 51 in accordance with the PWM signal input from the CR motor control section 31.

The CR motor control section 31 includes the measurement unit 31A that measures the position and the speed of the carriage 41 in the primary scanning direction based on the output signal (encoder signal) of the linear encoder 55. Then, the CR motor control section 31 performs the transporting control of the carriage 41 by feedback control based on the position and the speed of the carriage 41 measured by this measurement unit 31A.

The motor control section 30 includes a PF motor control section 35 besides this CR motor control section 31. The PF motor control section 35, based on the instruction from the CPU 11, generates a PWM signal as an input signal to the drive circuit 73 and controls the PF motor 71 composed of a direct-current motor. Thereby, the feeding control of the paper Q via the paper feeding mechanism 60 is achieved (details will be described later). The drive circuit 73 drives the PF motor 71 in accordance with the PWM signal input from the PF motor control section 35.

Figure 2:
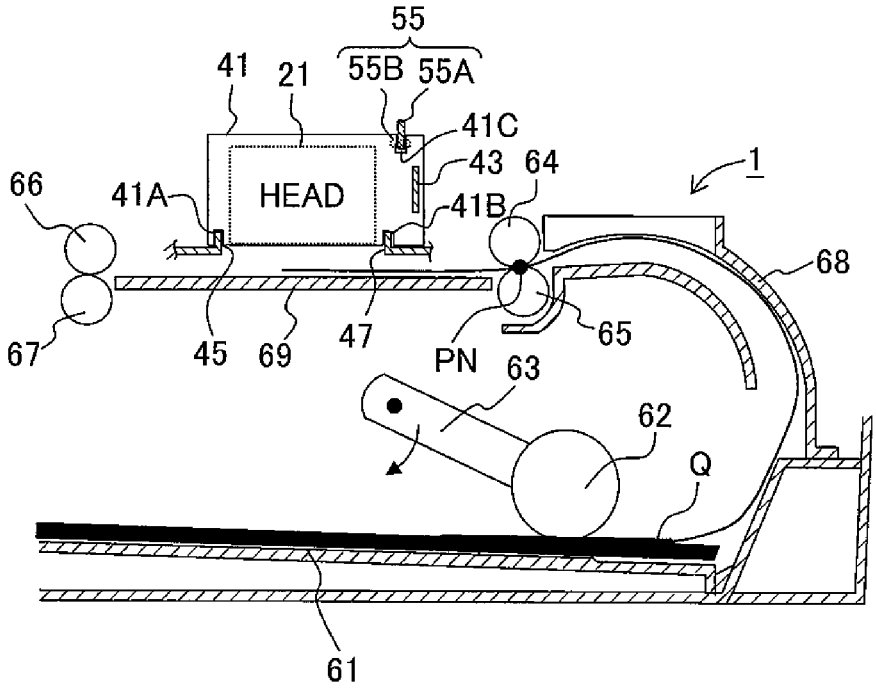
FIG. 2 is a view showing a configuration of a carriage transporting mechanism and a paper feeding mechanism.

Further, the paper feeding mechanism 60 includes a plurality of rollers 62, 64, 65, 66, and 67 each having a shaft parallel to the primary scanning direction as shown in FIG. 2. The paper feeding mechanism 60 feeds each of the papers Q placed in a paper feeding tray 61 in the secondary scanning direction by rotations of these rollers 62, 64, 65, 66, and 67. Then, by this feeding action, the paper Q is fed to a jetting position of ink droplets by the recording head 21 (an image forming position) and the paper Q on which the image has been formed by ink droplets jetted from the recording head 21 is discharged onto a not-illustrated paper discharge tray.

Here, a detailed constitution of the paper feeding mechanism 60 will be explained. The paper feeding mechanism 60 in this embodiment includes: the paper feeding tray 61; the paper feeding roller 62; an arm 63; the transporting roller 64; the pinch roller 65; the paper discharge roller 66; the spur roller 67; and a U-turn guide 68 and a platen 69 forming a paper feeding path.

In the paper feeding tray 61, the plural papers Q are stacked. The arm 63 holds the paper feeding roller 62 in a state of allowing the paper feeding roller 62 to rotate, and presses the paper feeding roller 62 against the surface of the paper Q stacked in the paper feeding tray 61 by using gravity force or biasing force by a spring. The paper feeding roller 62 rotates by power (driving force) of the PF motor 71 transmitted by a later-described power transmission mechanism 60A (see FIG. 3).

In the paper feeding mechanism 60, the paper feeding roller 62 rotates in a state of being pressed against the paper Q, and thereby a force in the secondary scanning direction being a feeding direction of the paper Q acts on the paper Q and the paper Q is fed to the paper feeding path positioned downstream in the secondary scanning direction. The paper Q fed from the paper feeding tray 61 is guided by the U-shaped U-turn guide 68 forming the paper feeding path to be fed between the transporting roller 64 and the pinch roller 65 in a state of bending.

The transporting roller 64 and the pinch roller 65 positioned downstream of the U-turn guide 68 are oppositely disposed so as to come into contact with each other. The transporting roller 64 and the pinch roller 65 each have a surface thereof coated with an elastic material.

The transporting roller 64 rotates by the power of the PF motor 71 transmitted by the power transmission mechanism 60A. The pinch roller 65 rotates with the rotation of this transporting roller 64. When the paper feeding roller 62 rotates forwardly and the paper Q is fed downstream in the paper feeding path from the paper feeding roller 62, the transporting roller 64 receives the power of the PF motor 71 to rotate reversely. A "reverse rotation" direction to be described here means a rotation direction reverse to the rotation direction in which the paper Q is fed downstream in the paper feeding path (a forward rotation direction).

Figure 4:
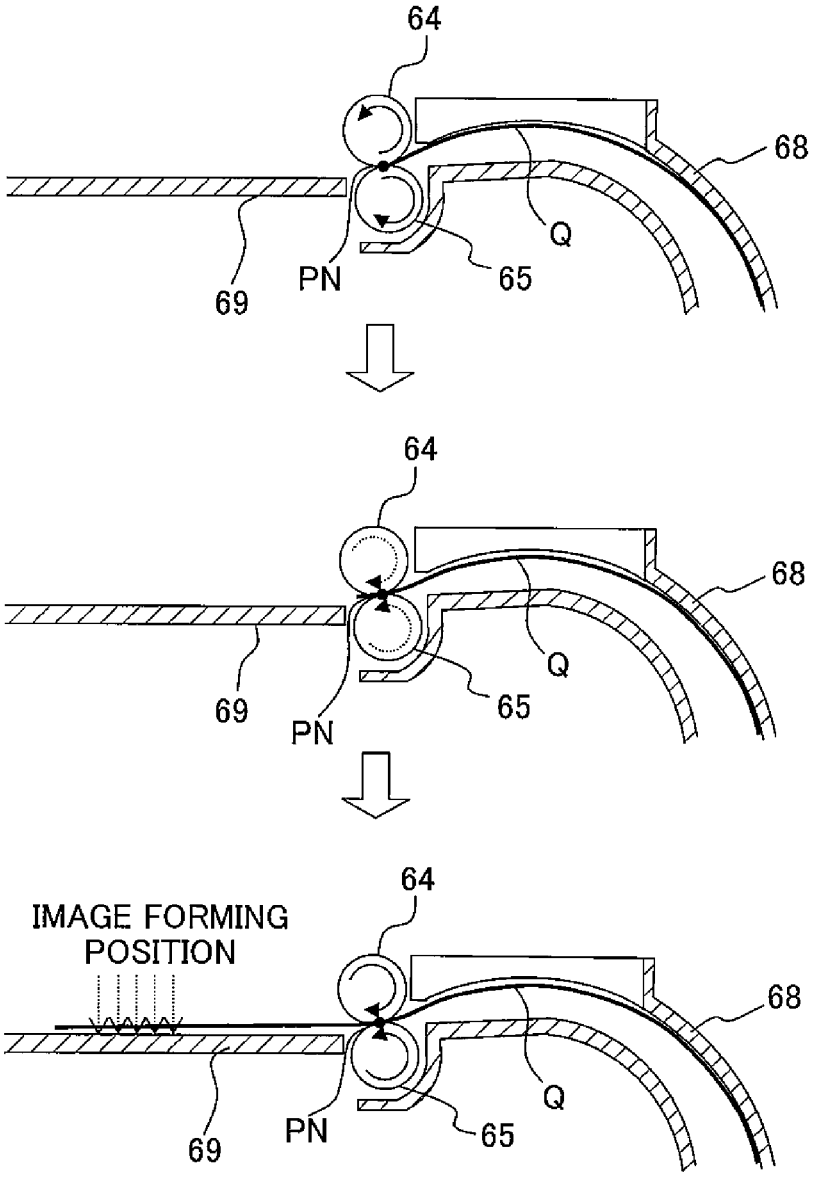
FIG. 4 is a view showing an action of a transporting roller and a movement of a paper.

By this reverse rotation, the paper Q fed from the paper feeding roller 62 is blocked from moving downstream at a nip portion PN being a contact point between the transporting roller 64 and the pinch roller 65 to be brought into a state of being butted against the nip portion PN (see the upper stage in FIG. 4). The paper Q is skew-corrected by this butting and in a state of the paper Q bending along the U-turn guide 68, its leading end is fed near the nip portion PN.

When the skew correction by this butting is completed, a rotation direction of the PF motor 71 is switched by the control of the PF motor control section 35, and thereby the transporting roller 64 rotates forwardly. The transporting roller 64 rotates forwardly, and thereby the paper Q is taken in through the nip portion PN between the transporting roller 64 and the pinch roller 65 and is fed downstream in the paper feeding path in a state of being sandwiched between the transporting roller 64 and the pinch roller 65.

Further, on the downstream side of the paper feeding path from the position where the transporting roller 64 and the pinch roller 65 are disposed, the platen 69 supporting the paper Q is provided. The paper Q to be fed downstream from the transporting roller 64 moves further downstream on the paper feeding path along the surface of the platen 69. From the recording head 21, ink droplets are jetted onto the paper Q supported by the platen 69, and thereby the image is formed.

Besides, the paper discharge roller 66 and the spur roller 67 are oppositely disposed to each other on the downstream side of the paper feeding path from the platen 69. The paper discharge roller 66 is coupled to the transporting roller 64 by a not-illustrated belt and rotates in synchronization with the transporting roller 64 to rotate for the same amount in a circumferential direction. Further, the spur roller 67 rotates in accordance with the rotation of the paper discharge roller 66.

The paper Q fed downstream along the platen 69 is sandwiched between the paper discharge roller 66 and the spur roller 67 and is fed further downstream by the rotation of the paper discharge roller 66. Thereafter, the paper Q is discharged onto the paper discharge tray (not illustrated) being an end point of the paper feeding path.

Figure 3:
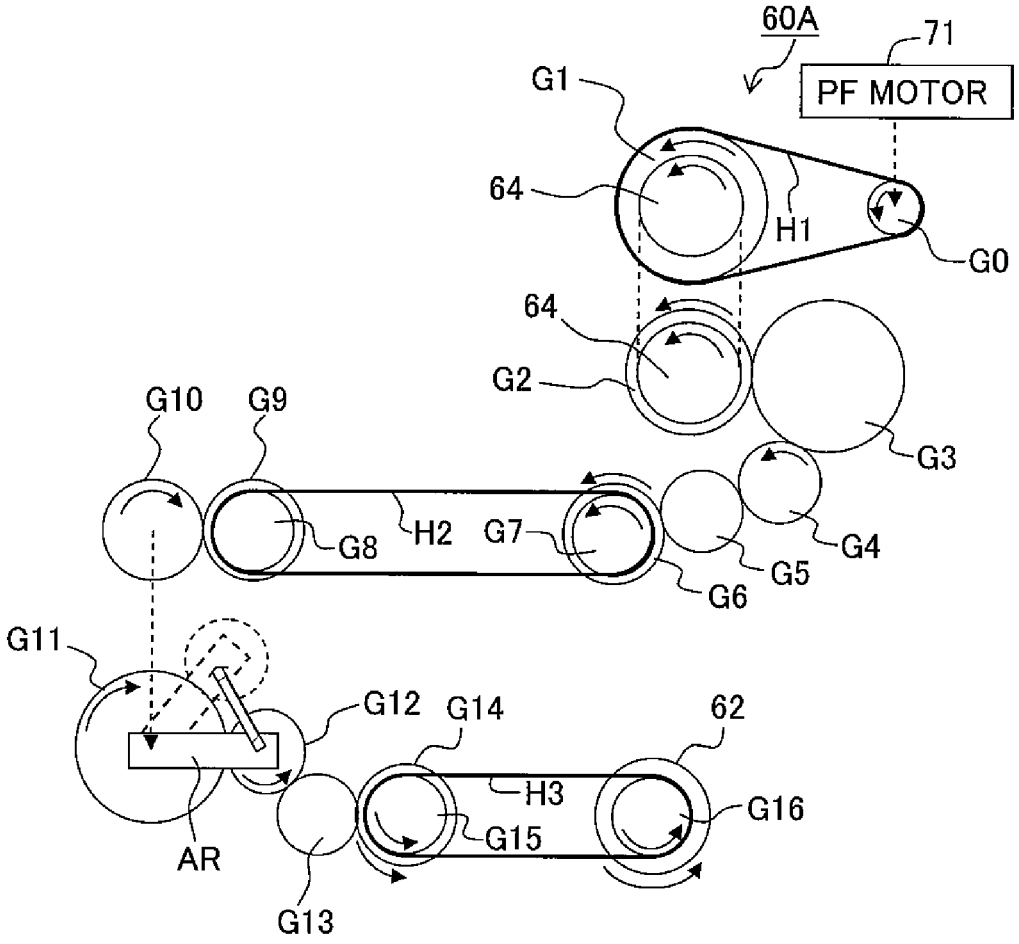
FIG. 3 is a view showing a configuration of a power transmission mechanism provided to the paper feeding mechanism.

Subsequently, a constitution of the power transmission mechanism 60A that the paper feeding mechanism 60 includes will be explained. In FIG. 3, the power transmission mechanism 60A from the PF motor 71 to the paper feeding roller 62 and the transporting roller 64 is shown. The power transmission mechanism 60A has gears G0 to G16 and belts H1 to H3.

In the power transmission mechanism 60A, the pinion gear G0 provided on the shaft of the PF motor 71 and the gear G1 provided on the same shaft as that of the transporting roller 64 are coupled via the belt H1 having recesses and projections engaging with the gears G0 and G1. Further, to the gear G2 provided on the same shaft as that of the transporting roller 64, the gears G3, G4, G5, and G6 are sequentially coupled. To the gear G7 provided on the same shaft as that of the gear G6, the gear G8 is coupled via the belt H2 engaging with the gears G7 and G8. Further, to the gear G9 provided on the same shaft as that of the gear G8, the gear G10 is coupled.

The gear G10 is provided on the same shaft as that of the sun gear G11, and when the gear G10 rotates, the sun gear G11 rotates in the same direction as the gear G10. Further, on the sun gear G11, the planetary gear G12 revolving around the sun gear G11 is provided, and the planetary gear G12 is connected to an arm AR pivotably connected on the shaft of the sun gear G11.

In the case when the PF motor 71 rotates in a first direction, this planetary gear G12, with the rotation, of the sun gear G11, in a solid-line arrow direction in FIG. 3, moves in a direction to approach the gear G13 to be coupled to the gear G13. Thereafter, the planetary gear G12, in a state of being coupled to the gear G13, rotates with the rotation of the sun gear G11.

On the other hand, in the case when the PF motor 71 rotates in a second direction being a direction reverse to the first direction, the planetary gear G12 moves in a direction to move away from the gear G13 with the rotation, of the sun gear G11, in a direction reverse to the solid-line arrow direction in FIG. 3. In FIG. 3, the disposition of the planetary gear G12 and the arm AR in a state of the planetary gear G12 being decoupled from the gear G13 is shown by a dotted line. In the power transmission mechanism 60A, a pivotable range of the arm AR is limited to a certain angle range, thereby making it possible to prevent the planetary gear G12 from being disposed at a position far away from the gear G13 needlessly.

Hereinafter, of the rotation directions of the PF motor 71, the first direction is expressed as the "forward rotation" direction and the second direction is expressed as the "reverse rotation" direction. Attention should be paid to the difference that with regard to the rotation directions of the paper feeding roller 62, the transporting roller 64, and so on, the direction in which the paper Q is fed downstream is defined as the "forward rotation" direction as described above.

Further, the gear G13 to be coupled to the planetary gear G12 is coupled to the gear G14, and to the gear G15 provided on the same shaft as that of the gear G14, the gear G16 is coupled via the belt H3 engaging with the gears G15 and G16. The gear G16 is provided on the same shaft as that of the paper feeding roller 62. Thus, when the planetary gear G12 is coupled to the gear G13, the paper feeding roller 62 rotates by the power from the PF motor 71 transmitted via these gears G0 to G16.

That is, when the PF motor 71 rotates forwardly, the paper feeding roller 62 rotates in the solid-line arrow direction in FIG. 3 by the power from the PF motor 71 transmitted via the power transmission mechanism 60A. Concretely, the paper feeding roller 62 rotates in the forward rotation direction in which the paper Q is fed downstream in the paper feeding path. At this time, the transporting roller 64 rotates in the reverse rotation direction. On the other hand, when the PF motor 71 rotates reversely, the paper feeding roller 62 is disconnected from the PF motor 71 to be brought into a free state. At this time, the transporting roller 64 rotates in the forward rotation direction.

Hereinafter, in the power transmission mechanism 60A, a power transmission system that is constituted by the planetary gear G12 and the gear G13 being coupled and transmits the power from the PF motor 71 to the paper feeding roller 62 is expressed as a "first power transmission system." On the other hand, in the power transmission mechanism 60A, a power transmission system that is constituted by the planetary gear G12 and the gear G13 being decoupled and does not transmit the power from the PF motor 71 to the paper feeding roller 62 is expressed as a "second power transmission system." The power transmission mechanism 60A in this embodiment is constituted to be able to switch the power transmission system according to the rotation direction of the PF motor 71 as above.

Further, the well-known incremental rotary encoder 75 is disposed so as to be provided on the same shaft as that of the transporting roller 64 to rotate by the power from the PF motor 71 transmitted via the above-described power transmission mechanism 60A. From the rotary encoder 75, a pulse signal (an encoder signal) corresponding to the rotation of the transporting roller 64 is output, and the output pulse signal is input to a measurement unit 35A (see FIG. 1) that the PF motor control section 35 includes.

The measurement unit 35A measures the rotation amount and the rotation speed of the transporting roller 64 that the paper feeding mechanism 60 includes based on the pulse signal (encoder signal) output from the rotary encoder 75. The PF motor control section 35 performs rotation control of the transporting roller 64 by feedback control based on the rotation amount and the rotation speed of the transporting roller 64 measured by the measurement unit 35A. Thereby, the feeding control of the paper Q by the paper feeding roller 62, the transporting roller 64, and the paper discharge roller 66 is achieved.

Incidentally, in the printer apparatus 1 in this embodiment, by the power transmission through the above-described first power transmission system, the paper feeding roller 62 is made to rotate forwardly in a state of the transporting roller 64 being made to rotate reversely. Thereby, the printer apparatus 1 feeds the paper Q from the paper feeding roller 62 so as to butt against the intake position of the paper Q by the transporting roller 64 (nip portion PN) (see upper diagram in FIG. 4). Thereby, the skew correction of the paper Q is achieved. Thereafter, by the power transmission through the above-described second power transmission system, the rotation direction of the PF motor 71 is switched from the forward rotation direction to the reverse rotation direction to make the transporting roller 64 rotate forwardly. Thereby, the printer apparatus 1 feeds the paper Q downstream in the paper feeding path through the nip portion PN to perform a head poke of the paper Q (see lower diagram in FIG. 4).

As is well known, the head poke of the paper Q is a process to feed the paper Q so that a starting point of an image forming target area on the paper Q may be fed to the jetting position of ink droplets by the recording head 21 (image forming position). Whether or not the head poke of the paper Q can be performed with high positional accuracy affects the quality of the image to be formed on the paper Q.

According to the constitution of the printer apparatus 1 in this embodiment, immediately before the head poke of the paper Q, a phenomenon in which the transporting roller 64 rotates naturally occurs (see middle of FIG. 4). In the middle of FIG. 4, how the transporting roller 64 rotates naturally in a state where the motor is not allowed to be driven is shown by a dotted-line arrow.

That is, at the time of the skew correction, the PF motor 71 is made to rotate forwardly to make the transporting roller 64 rotate reversely, but at the time of the head poke, the PF motor 71 is made to rotate reversely to make the transporting roller 64 rotate forwardly. Then, at the time of switching the rotation direction of the PF motor 71, the PF motor 71 becomes off once to thereby make a state where the power from the PF motor 71 is not transmitted to the gears G0 to G16 constituting the power transmission mechanism 60A. For this reason, at the time of switching the rotation direction of the PF motor 71, the gears G0 to G16 rotate in a direction reverse to the direction in which the gears G0 to G16 have rotated so far in order to eliminate loads acting thereon, and the transporting roller 64 rotates naturally in the forward rotation direction without the power from the PF motor 71.

Further, between the transporting roller 64 and the pinch roller 65, a restoring force ascribed to the fact that the paper Q tries to eliminate the bending caused by the skew correction acts. In other words, a force forcing the leading end of the paper Q to move downstream in the paper feeding path acts. For this reason, at the time of switching the rotation direction of the PF motor 71, the restoring force of the paper Q acts and the transporting roller 64 rotates naturally in the forward rotation direction.

As it is understandable with reference to the middle of FIG. 4, such a rotation phenomenon causes a positional displacement of the paper Q at the time of the start of the head poke. Thus, according to the constitution of the printer apparatus 1, the positional displacement of the paper Q caused by this rotation phenomenon adversely affects the positional accuracy related to the head poke of the paper Q.

Further, when the paper Q is butted against the nip portion PN to perform the skew correction, as a result, the degree of entry into the nip portion PN differs depending on the type of the paper Q slightly. For example, between the case that the paper Q is thin and the case that the paper Q is thick as shown in the upper and lower diagrams in FIG. 5 respectively, an error $\Delta\alpha$ in a leading end position of the paper Q occurs. For this reason, an error in the position of the paper Q relative to the nip portion PN caused by the type of the paper Q adversely affects the positional accuracy related to the head poke of the paper Q.

Thus, in this embodiment, a target rotation amount RT of the transporting roller 64 at the time of the head poke is corrected, to thereby suppress the effects of the positional displacement by the above-described rotation phenomenon and the positional displacement by the type of the paper Q on the positional accuracy at the time of the head poke. This makes it possible to highly accurately dispose (feed) the leading end of the paper Q at (to) a position where the paper Q has advanced from the nip portion PN for a predetermined distance D.

Subsequently, as processing including steps for correcting the above-described target rotation amount RT, there will be explained the printing control processing that the CPU 11 executes and the processing that the PF motor control section 35 executes based on the instruction from the CPU 11 in the printing control processing.

Figure 6:
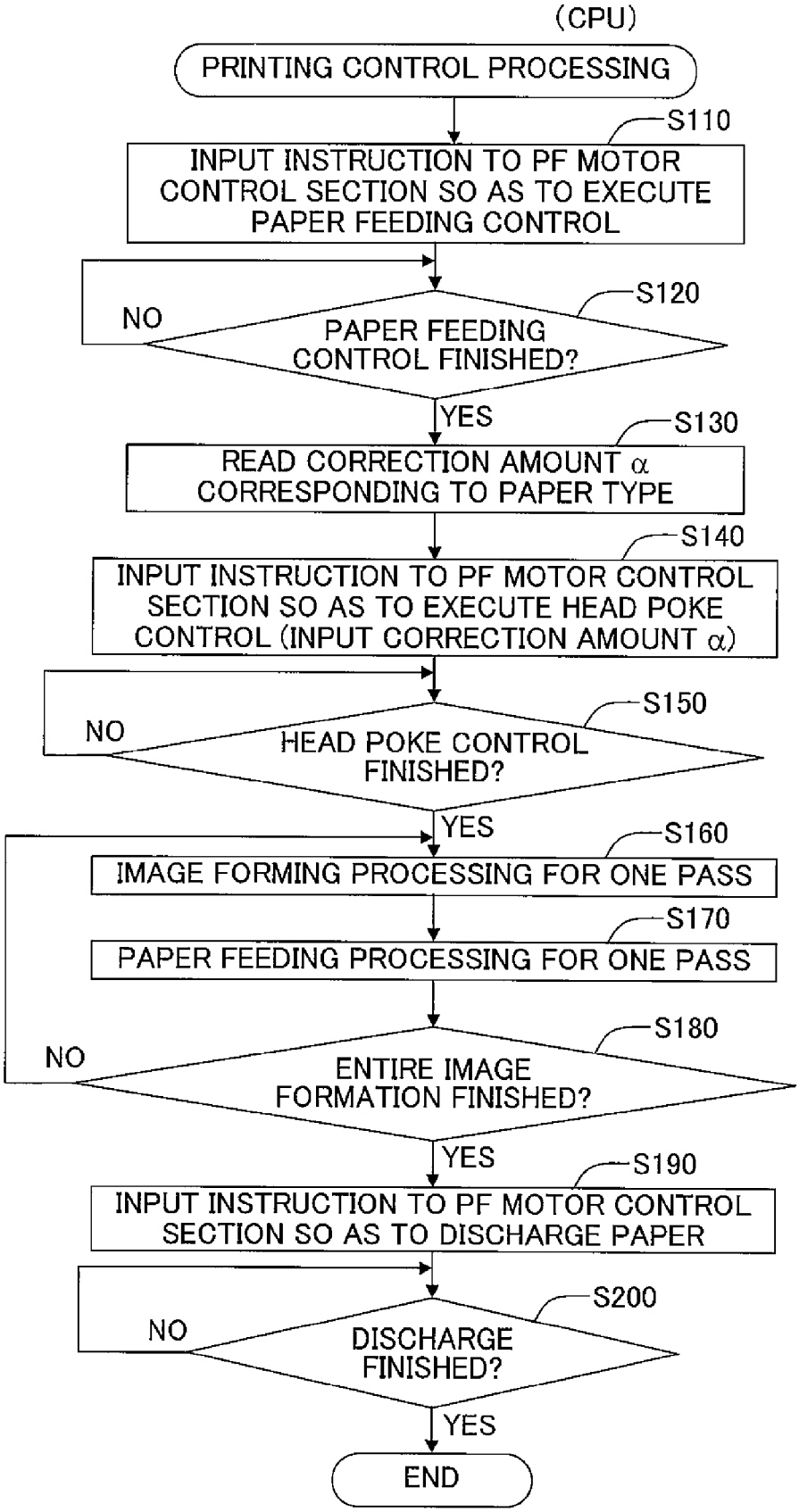
FIG. 6 is a flowchart showing printing control processing executed by a CPU.

The CPU 11 starts the printing control processing shown in FIG. 6 when receiving the print instruction and the print target data from the PC 3 through the connection interface 19. In the case when the print target data is data corresponding to a plurality of papers, the CPU 11 executes the printing control processing on each single paper.

When starting the printing control processing, the CPU 11 inputs the instruction to the PF motor control section 35 to instruct the PF motor control section 35 to execute paper feeding control processing (S110). The paper feeding control processing is processing to control the rotations of the paper feeding roller 62 and the transporting roller 64 via the PF motor 71 and feed the paper Q from the paper feeding roller 62 so as to butt against the nip portion PN being the intake position of the paper Q by the transporting roller 64. By this processing, the paper Q is skew-corrected and is disposed near the nip portion PN in a state of bending as described above (see upper diagram in FIG. 4).

The CPU 11, after this instruction input, waits until the paper feeding control processing executed by the instruction input is ended (S120). Then, when the paper feeding control processing ends (Yes in S120), the CPU 11 reads a correction amount $\alpha$ corresponding to the type of the paper Q fed to the transporting roller 64 side by this paper feeding control processing from the EEPROM 15 (S130).

Concretely, the CPU 11 specifies the type of the above-described fed paper Q from information of the type of the paper Q notified from the PC 3 at the time of the print instruction, and reads the correction amount $\alpha$ corresponding to the specified type of the paper Q from the EEPROM 15. As the type of the paper Q, types of the paper Q classified according to thickness can be cited as one example.

That is, in S130 in this embodiment, in the case when the specified type of the paper Q is a plain paper, the CPU 11 reads the correction amount $\alpha=\alpha1$ corresponding to a plain paper from the EEPROM 15. On the other hand, in the case when the specified type of the paper Q is a thick paper, the CPU 11 reads the correction amount $\alpha=\alpha2$ corresponding to a thick paper from the EEPROM 15.

Figure 5:
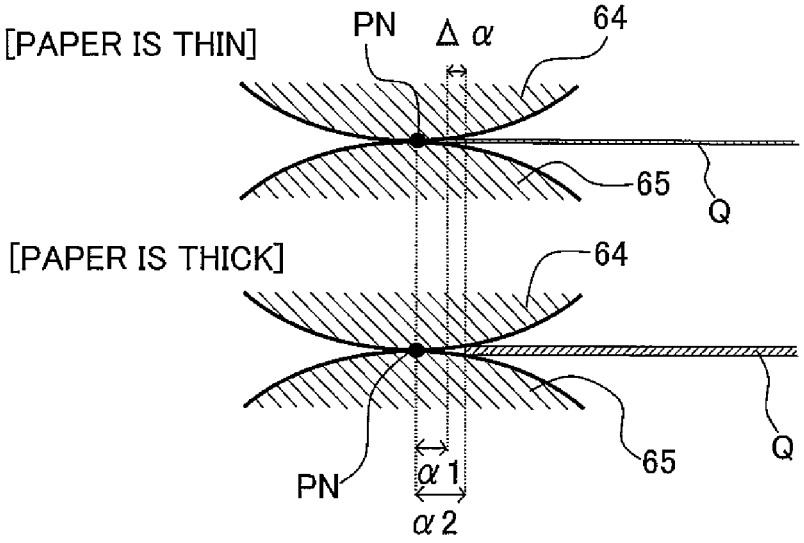
FIG. 5 is a view showing a difference in degree of entry of the paper into a nip portion by a difference in thickness of the paper.

The correction amounts $\alpha=\alpha1$ and $\alpha2$ each correspond to an error in the leading end position from the nip portion PN when the paper Q is fed near the nip portion PN by the paper feeding control processing as shown in FIG. 5. The correction amount $\alpha$ is defined as a parameter taking a negative value in the case when the leading end position of the paper is positioned on the upstream side in the paper feeding path from the nip portion PN.

The correction amounts $\alpha=\alpha1$ and $\alpha2$ can be obtained by for example, a designer of the printer apparatus 1 by experiments. In the EEPROM 15, the correction amounts $\alpha$ obtained by the above-described experiments are stored beforehand in a manner to correspond to each type of the paper Q (each thickness of the paper Q).

When reading the correction amount $\alpha$ corresponding to the type of the above-described fed paper Q from the EEPROM 15 in S130, the CPU 11 proceeds to S140 and inputs an instruction to the PF motor control section 35 to instruct the PF motor control section 35 to execute head poke control processing (S140). The head poke control processing is processing to control the rotation of the transporting roller 64 via the PF motor 71 and feed the paper Q downstream in the paper feeding path from the nip portion PN to perform the head poke of the paper Q.

In S140, as an operation accompanied by the instruction input, an operation of setting a standard target rotation amount RT0 and the correction amount $\alpha$ read in S130 is performed to the PF motor control section 35. The standard target rotation amount RT0 is a rotation amount of the transporting roller 64 necessary for feeding the starting point of the image forming target area on the paper Q to the jetting position of ink droplets by the recording head 21 (image forming position) in the case when at the time of the start of the head poke control processing, the leading end of the paper Q is in an ideal state of being disposed so as to completely agree with the nip portion PN.

When ending the processing in S140, the CPU 11 waits until the head poke control processing by the PF motor control section 35 is ended (S150). Then, when the head poke control processing ends (Yes in S150), the CPU 11 executes image forming processing for one pass (S160). The image forming processing for one pass is processing to input an instruction to the head control section 20 and the CR motor control section 31 to move the carriage 41 for one way (for one pass) from, of a carriage feeding path, a returning point corresponding to a current position of the carriage 41 to a returning point on the downstream side in the primary scanning direction and to jet ink droplets onto an area (an area for one pass) of the paper Q above which the carriage 41 passes to thereby form an image. By the image forming processing, of the paper Q, on the area for one pass in the primary scanning direction that has a predetermined width in the secondary scanning direction, a linear image (a line image) is formed.

Further, when the image forming processing for one pass is ended, the CPU 11 proceeds to S170 to execute paper feeding processing for one pass (S170). The paper feeding processing for one pass is processing to input an instruction to the PF motor control section 35 and to feed the paper Q downstream in the secondary scanning direction only for a distance corresponding to the width (above-described predetermined width) in the secondary scanning direction of the line image formed on the paper Q in the image forming processing for one pass in S160. When receiving the instruction, the PF motor control section 35 controls the rotation of the transporting roller 64 via the PF motor 71 and rotates the transporting roller 64 only for an amount of the paper Q being fed for the above-described distance, to thereby feed the paper Q downstream in the secondary scanning direction only for the above-described distance.

The CPU 11 alternately executes the image forming processing for one pass and the paper feeding processing for one pass as above repeatedly to perform the image formation on the entire image forming target area of the paper Q (S160 and S170). Then, when the image formation on the entire image forming target area is completed (Yes in S180), the CPU 11 inputs an instruction to the PF motor control section 35 to thereby instruct the PF motor control section 35 to control the PF motor 71 so that the paper Q may be discharged onto the paper discharge tray (S190).

Then, when the discharge of the paper Q by the control of the PF motor control section 35 is ended (Yes in S200), the CPU 11 ends the printing control processing. In the printer apparatus 1 in this embodiment, the printing control processing having such a content is executed.

Figure 7:
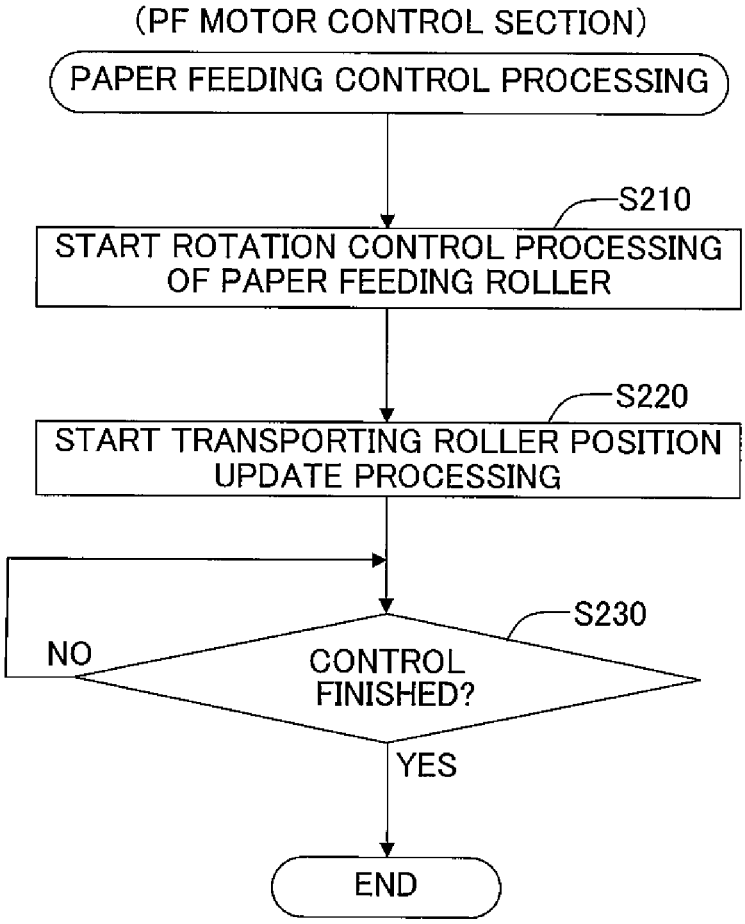
FIG. 7 is a flowchart showing paper feeding control processing executed by a PF motor control section.

Subsequently, there will be explained details of the paper feeding control processing that the PF motor control section 35 executes based on the instruction input from the CPU 11 generated in S110 with reference to FIG. 7. When starting the paper feeding control processing, the PF motor control section 35 starts rotation control processing of the paper feeding roller 62 so that the paper feeding roller 62 may rotate more than the rotation amount of the transporting roller 64 of making the paper Q reach the nip portion PN by a predetermined amount γ by the control of the PF motor 71 in accordance with the instruction input from the CPU 11 (S210). Incidentally, the predetermined amount γ can be determined by the designer at a design stage in consideration of a slip between the paper feeding roller 62 and the paper Q, an error in a placement position of the paper Q in the paper feeding tray 61, a feeding amount necessary for the skew correction, and so on. The rotation amount of the paper feeding roller 62 can be obtained by applying a proportionality coefficient to the rotation amount of the transporting roller 64 measured in the measurement unit 35A. According to this rotation control processing, the paper feeding roller 62 rotates in the forward rotation direction in a manner to correspond to the rotation, of the PF motor 71, in the forward rotation direction, and further the transporting roller 64 rotates in the reverse rotation direction.

Figure 8A:
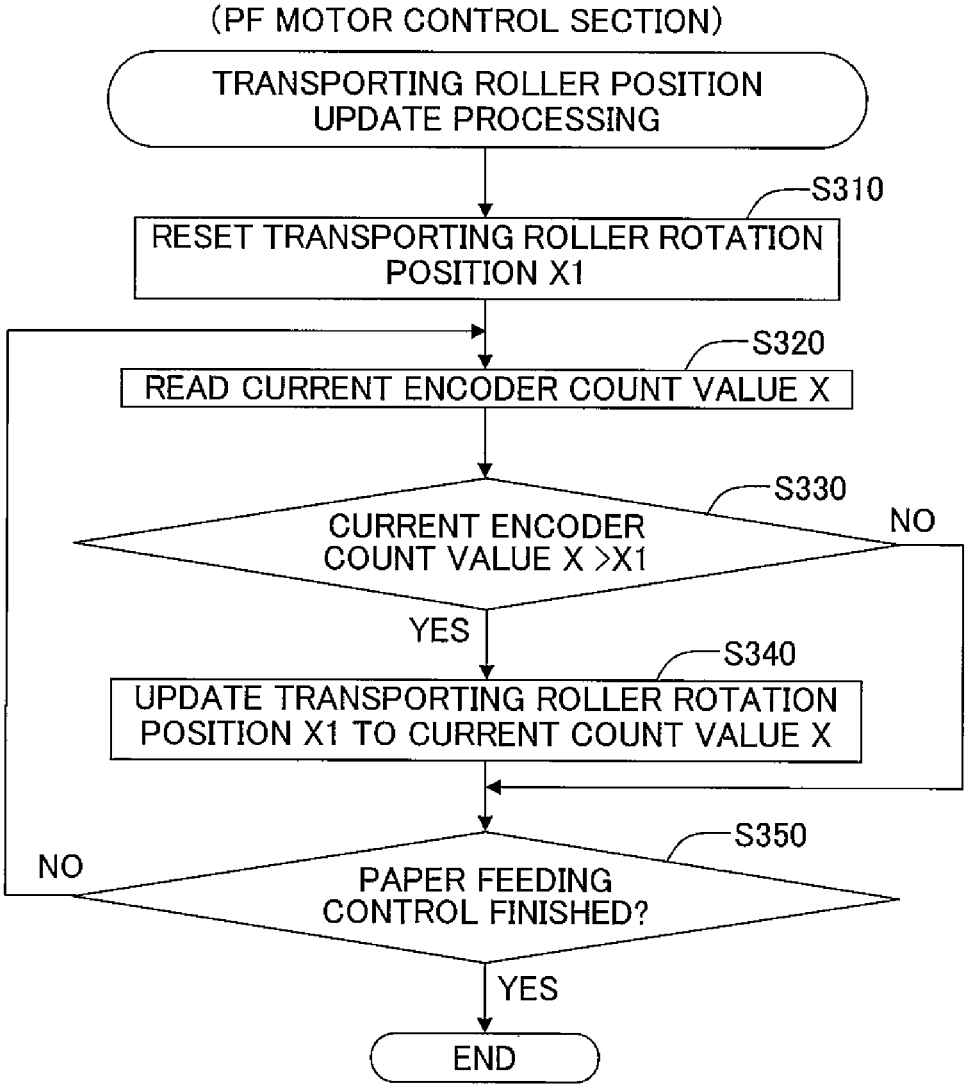
FIG. 8A is a flowchart showing transporting roller position update processing executed by the PF motor control section.

Further, the PF motor control section 35 starts transporting roller position update processing shown in FIG. 8A in conjunction with starting the above-described rotation control processing (S220). Thereafter, the PF motor control section 35 waits until the rotation control processing started in S210 is ended (S230), and ends the paper feeding control processing.

When starting the transporting roller position update processing, the PF motor control section 35 resets a transporting roller rotation position X1 to zero (S310), and then reads a current encoder count value X that the measurement unit 35A has (S320).

Incidentally, the encoder count value X indicates a measurement value of the rotation amount of the transporting roller 64. The measurement unit 35A adds one to the encoder count value X every time the measurement unit 35A detects a pulse edge (a rising edge, a falling edge, or the both) of the encoder signal input from the encoder 75 when the transporting roller 64 rotates reversely. Incidentally, the rotation direction of the transporting roller 64 can be specified from a phase difference between an A phase signal and a B phase signal output from the encoder 75 as the encoder signal.

On the other hand, the measurement unit 35A subtracts one from the encoder count value X every time the measurement unit 35A detects the above-described pulse edge of the encoder signal input from the encoder 75 when the transporting roller 64 rotates forwardly. The measurement unit 35A measures the rotation amount of the transporting roller 64 by such addition and subtraction processing of the encoder count value X. This encoder count value X is reset to zero at the time of the start of the rotation control processing in S210.

When ending the processing in S320, the PF motor control section 35 judges whether or not the read current encoder count value X is larger than the transporting roller rotation position X1 stored currently (S330). When judging here that it is larger (Yes in S330), the PF motor control section 35 updates the transporting roller rotation position X1 to the above-described read current encoder count value X (S340) and proceeds to S350.

On the other hand, when judging that the read current encoder count value X is equal to or less than the transporting roller rotation position X1 (No in S330), the PF motor control section 35 does not update the transporting roller rotation position X1 and proceeds to S350.

When proceeding to S350, the PF motor control section 35 judges whether or not the paper feeding control processing is ended. When judging that the paper feeding control processing is not ended (No in S350), the PF motor control section 35 proceeds to S320. Thereby, while the paper feeding control processing is in execution, the PF motor control section 35 repeatedly executes the processings in S320 to S340 in parallel with the above execution. Then, when the paper feeding control processing is ended (Yes in S350), the PF motor control section 35 ends the transporting roller position update processing.

Figure 8B:
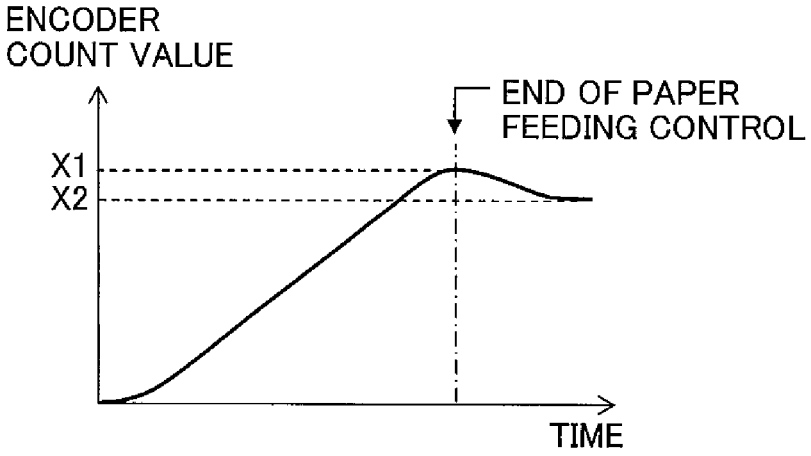
FIG. 8B is a graph showing a time change in an encoder count value.

Thereby, while the transporting roller 64 is rotating reversely by the paper feeding control processing, the PF motor control section 35 sequentially updates the transporting roller rotation position X1 in the reverse rotation direction. Then, as shown in FIG. 8B, the PF motor control section 35 sets the transporting roller rotation position as X1 finally and stores the maximum encoder count value X at the time when the paper feeding control processing is ended in the RAM 13. The transporting roller rotation position X1 is stored in the RAM 13 until at least processing in S430 in the head poke control processing (see FIG. 9) is executed.

Figure 9:
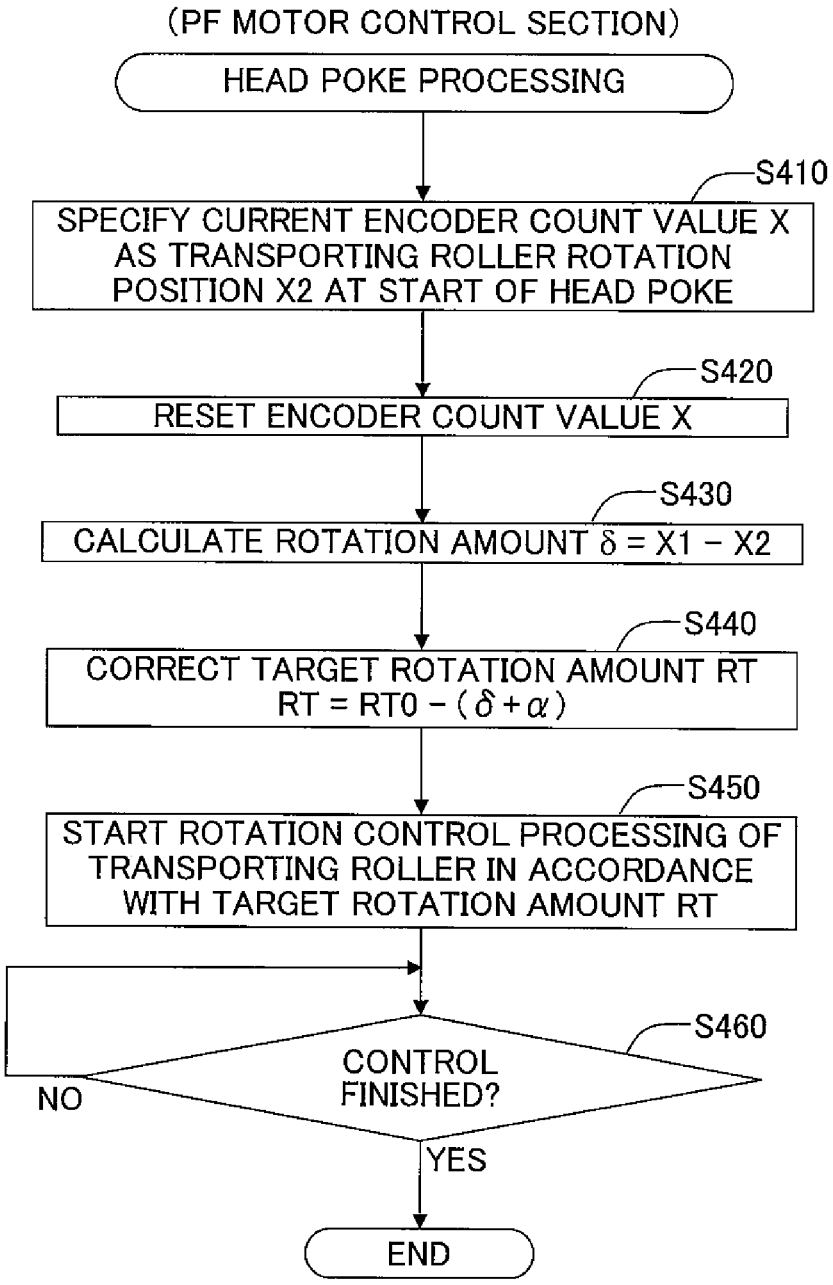
FIG. 9 is a flowchart showing head poke control processing executed by the PF motor control section.

Subsequently, there will be explained details of the head poke control processing that the PF motor control section 35 executes based on the instruction input from the CPU 11 generated in S140 (see FIG. 6) with reference to FIG. 9. When starting the head poke control processing, the PF motor control section 35 executes processings for correcting the target rotation amount RT of the transporting roller 64 from the standard target rotation amount RT0 set by the CPU 11 (S410 to S440) before starting rotation control processing (S450) in accordance with an instruction input from the CPU 11.

In S410, the PF motor control section 35 reads the current encoder count value X that the measurement unit 35A has. Then, the PF motor control section 35 specifies the read encoder count value X as a transporting roller rotation position X2 at the time of the start of the head poke.

Thereafter, the PF motor control section 35 resets the encoder count value X to zero (S420). Further, the PF motor control section 35 calculates a rotation amount $\delta=X1-X2$ being a difference between the above-described transporting roller rotation position X1 stored in the transporting roller position update processing and the above-described specified transporting roller rotation position X2 at the time of the start of the head poke (S430).

As described above, the encoder count value X is a parameter to increase when the transporting roller 64 rotates reversely. For this reason, the rotation amount 6 corresponds to the rotation amount in the forward rotation direction of which the transporting roller 64 has rotated from the time when the paper feeding control processing ends to the time when the head poke control processing starts. This rotation does not derive from the drive of the PF motor 71, and occurs due to the fact as one of the causes that in a transitional period from the paper feeding control processing to the head poke control processing, the PF motor 71 is once set to off (namely, a drive current to be input to the PF motor 71 is once set to zero) for switching the rotation direction of the PF motor 71. This rotation occurs in a period of the encoder count value being X1 to X2 as shown in FIG. 8B. By this rotation, the paper Q is disposed at a position where the paper Q has advanced downstream in the paper feeding path from the position at the time when the paper feeding control processing is ended only for a distance corresponding to the rotation amount $\delta$.

When ending the processing in S430, the PF motor control section 35 performs the processing of correcting the target rotation amount RT from the standard target rotation amount RT0 based on the above-described calculated rotation amount $\delta$ and the correction amount $\alpha$ set by the CPU 11 at the time of the instruction input in S140. Concretely, the PF motor control section 35 corrects the target rotation amount RT from the standard target rotation amount RT0 in accordance with $RT=RT0-(\delta+\alpha)$ (S440).

Thereafter, the PF motor control section 35 starts the rotation control processing of the transporting roller 64 via the PF motor 71 so that the transporting roller 64 may stop at the point where the transporting roller 64 has rotated only for the target rotation amount RT based on the target rotation amount RT set in S440 (S450).

As described above, this rotation control processing is achieved by feedback control based on the rotation amount of the transporting roller 64 measured in the measurement unit 35A (encoder count value X). The encoder count value X is reset to zero in S420. For this reason, in the rotation control processing, with reference to the encoder count value X, the PF motor 71 is controlled so that the rotation of the transporting roller 64 may stop at the point where an absolute value $|X|$ of the encoder count value X becomes the target rotation amount RT.

When the rotation control processing of the transporting roller 64 started in S450 is ended (Yes in S460), the PF motor control section 35 ends the head poke control processing.

In the foregoing, the constitution of the printer apparatus 1 in this embodiment has been explained, but according to this embodiment, there is obtained information indicating the rotation amount 6 of the transporting roller 64 by the rotation phenomenon of the transporting roller 64 to occur in the period from the time when the paper feeding control processing is ended to the start of the head poke control processing by monitoring the encoder count value X. Further, the correction amount $\alpha$ corresponding to the error in the position from the nip portion PN by the type (thickness) of the paper Q is read from the EEPROM 15 to be obtained.

Then, based on these rotation amount 6 and correction amount $\alpha$, the target rotation amount RT of the transporting roller 64 at the time of the head poke control is corrected from the standard target rotation amount RT0, and based on the corrected target rotation amount RT, the rotation of the transporting roller 64 is controlled. Thereby, the effect of the positional displacement of the paper Q caused by the natural rotation of the transporting roller 64 to occur in the transitional period from the paper feeding control processing to the head poke control processing is suppressed, and the head poke of the paper Q is performed highly accurately. Thus, according to this embodiment, it is possible to form a higher-quality image on the paper Q than ever before and provide the high-performance printer apparatus 1 to consumers.

Incidentally, in this embodiment, the paper feeding roller 62 and the transporting roller 64 are driven by the PF motor 71 being a common single motor, so that in the power transmission mechanism 60A, the plural power transmission systems are provided and the planetary gear G12 for switching these power transmission systems is disposed to be able to be decoupled from the gear G13. In such a constitution, when the PF motor 71 is off due to the switching of the rotation direction of the PF motor 71, the balance of force in the power transmission mechanism 60A is likely to be lost and the amount of the transporting roller 64 rotating naturally is likely to increase.

Thus, when the technique of this embodiment is applied to the printer apparatus including the power transmission mechanism 60A capable of switching the plural power transmission systems as above, it is possible to effectively improve the positional accuracy of the head poke.

However, although driving the paper feeding roller 62 and the transporting roller 64 by the common single motor and the constitution of the power transmission mechanism 60A cause the natural rotation of the transporting roller 64, the force acting on the transporting roller 64 by the bending of the paper Q is also one of the causes for the natural rotation of the transporting roller 64. For this reason, the technique of this embodiment can be applied also to a printer apparatus in which the paper feeding roller 62 and the transporting roller 64 are driven by separate motors.

Further, in this embodiment, the printer apparatus 1 in which the power transmission system is switched by switching the rotation direction of the PF motor 71 has been explained, but the technique of this embodiment can be applied also to a printer apparatus such that without switching the rotation direction of the PF motor 71, the power transmission system is switched by an operation of a drive source different from the PF motor 71 to switch the rotation direction of the transporting roller 64.

Further, the size of the force acting on the transporting roller 64 from the paper Q, being one of the reasons for causing the natural rotation of the transporting roller 64, also changes depending on the width in the primary scanning direction (breadth) of the paper Q. That is, as the breadth of the paper Q is larger, the force to act on the transporting roller 64 from the paper Q at the time of the skew correction becomes larger to make the transporting roller 64 rotate more easily. On the other hand, with regard to the paper Q having a short breadth such as a postcard, the force to act on the transporting roller 64 from the paper Q is small, so that the transporting roller 64 does not rotate easily. Thus, in the case when the breadth of the paper Q is short, it is also possible to design so that the target rotation amount RT may not be corrected from the standard target rotation amount RT0 (a modified embodiment).

[Modified Embodiment]

Subsequently, a printer apparatus 1 in a modified embodiment will be explained. However, the printer apparatus 1 in the modified embodiment differs from the printer apparatus 1 in the above-described embodiment in the content of the printing control processing that the CPU 11 executes and the content of the head poke control processing that the PF motor control section 35 executes. Thus, hereinafter, the processing contents different from those of the printer apparatus 1 in the above-described embodiment will be selectively explained and other explanations will be appropriately omitted.

Figure 10A:
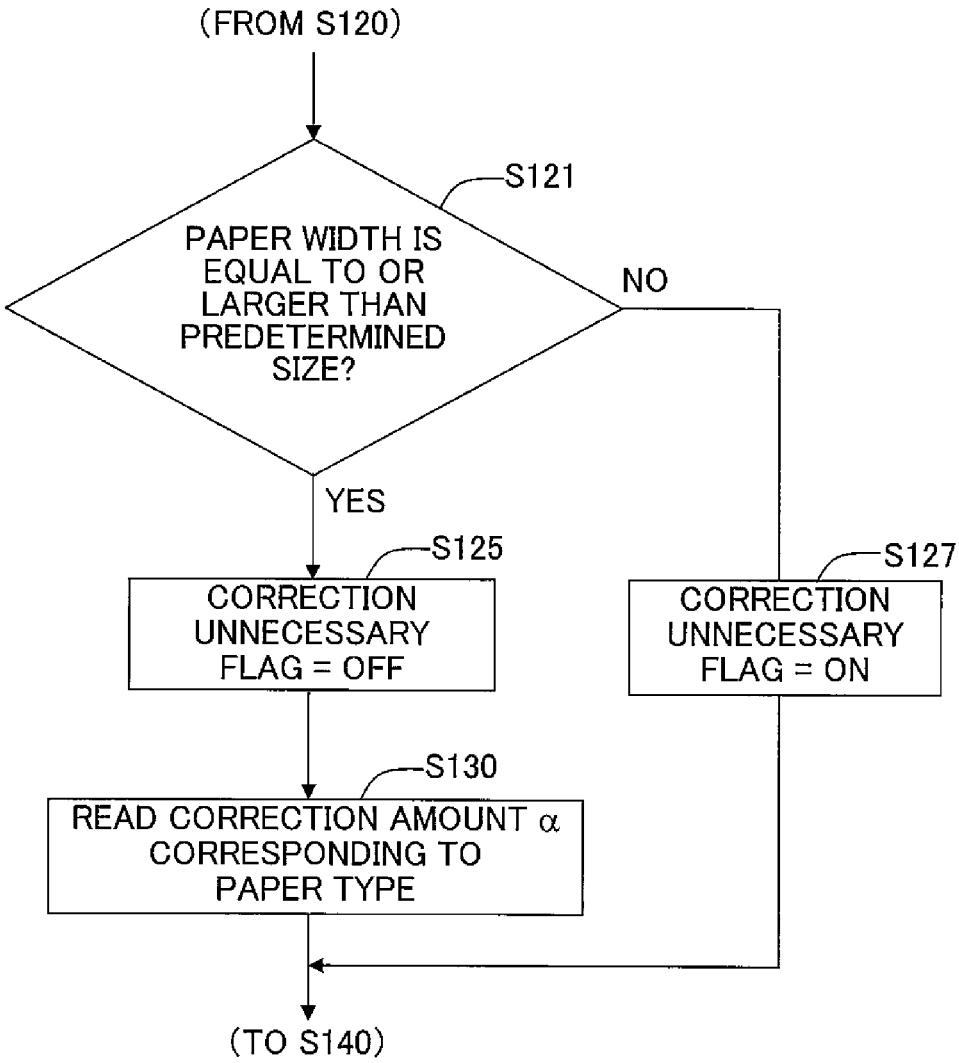
FIG. 10A is a flowchart showing the printing control processing in a modified embodiment.

In the printing control processing that the CPU 11 in the modified embodiment executes, as shown in FIG. 10A, when the paper feeding control processing is ended (Yes in S120), before reading the correction amount α from the EEPROM 15 (S130), the CPU 11 judges whether or not the breadth being the width in the primary scanning direction of the paper Q fed to the transporting roller 64 side in the paper feeding control processing is equal to or larger than a predetermined size (S121).

This judgment can be performed based on the information of the type of the paper Q notified from the PC 3 at the time of the print instruction. However, size information of the paper Q is set to be included in the notified information. Further, the above-described "predetermined size" to be a judgment standard can be determined by the designer of the printer apparatus 1 at a designing stage.

When judging that the breadth of the paper Q is equal to or larger than the predetermined size (Yes in S121), the CPU 11 sets a correction unnecessary flag to off (S125), and then proceeds to S130. On the other hand, when judging that the breadth of the paper Q is smaller than the predetermined size (No in S121), the CPU 11 sets the correction unnecessary flag to on (S127), and then proceeds to S140. However, in S140 after having set the correction unnecessary flag to on in S127, the CPU 11 sets the value of the correction amount α in the PF motor control section 35 as zero.

Figure 10B:
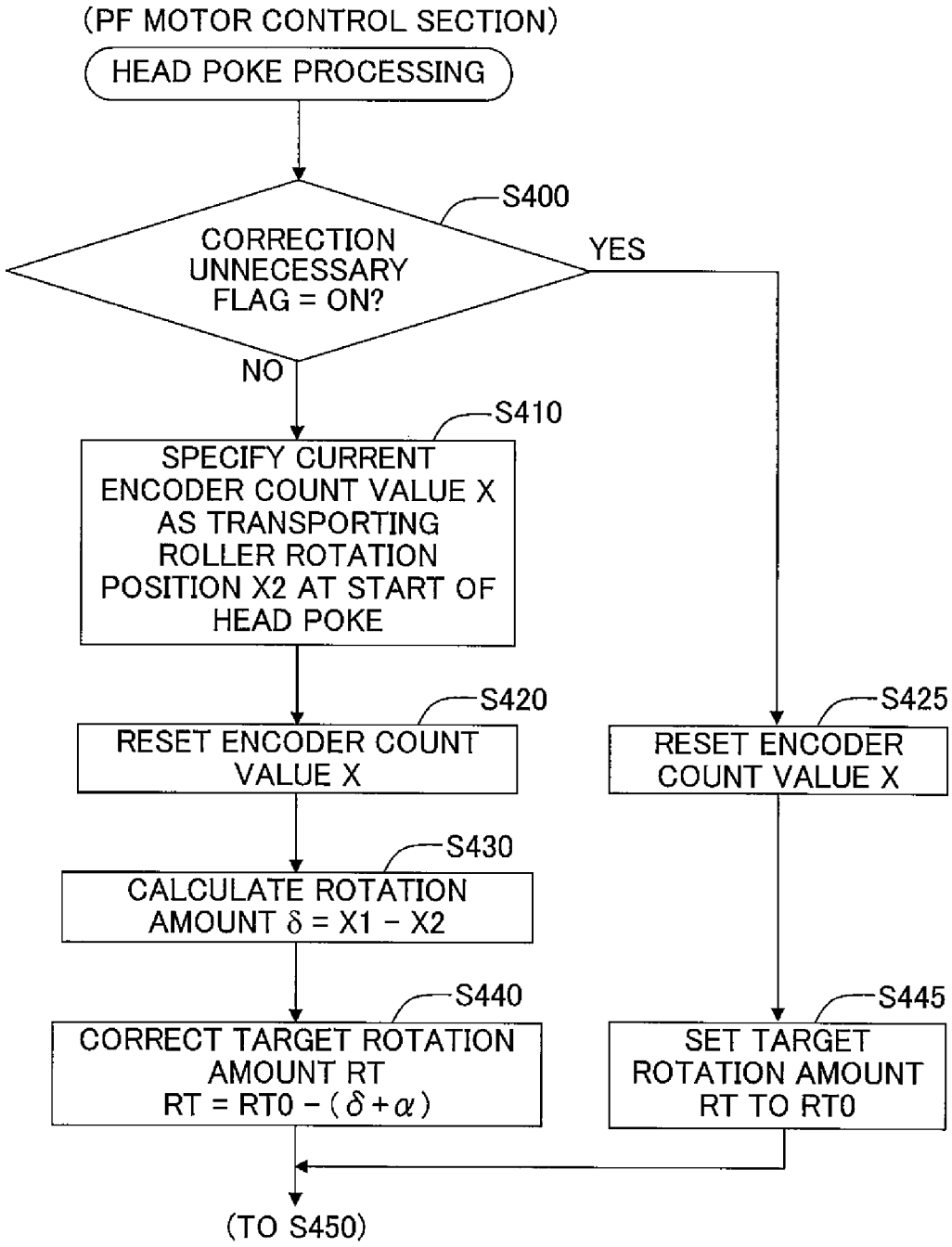
FIG. 10B is a flowchart showing the head poke control processing in the modified embodiment.

The PF motor control section 35 in the modified embodiment executes the head poke control processing shown in FIG. 10B in accordance with the instruction input from the CPU 11 by the processing in S140. When executing the head poke control processing, the PF motor control section 35, before executing processing in S410, judges whether or not the correction unnecessary flag has been set to on in S400.

Then, when judging that the correction unnecessary flag has been set to off (No in S400), the PF motor control section 35 executes processings in and after S410 similarly to the above-described embodiment. In contrast to this, when judging that the correction unnecessary flag has been set to on (Yes in S400), the PF motor control section 35 resets the encoder count value X to zero (S425) and sets the target rotation amount RT to the standard target rotation amount RT0 (S445), and then proceeds to S450. That is, in the case when the correction unnecessary flag has been set to on, the PF motor control section 35 performs the head poke of the paper Q without correcting the target rotation amount RT from the standard target rotation amount RT0.

Such a modified embodiment also makes it possible to sufficiently secure the positional accuracy of the head poke and form a good quality image on the paper Q.

[Another Embodiment]

In the foregoing, the embodiments of the present invention including the modified embodiment have been explained, but the present invention is not limited to the above-described embodiments and is applicable to various aspects.

For example, according to the above-described embodiments, the correction amount α corresponding to each thickness of the paper Q is designed to be stored in the EEPROM 15, but the correction amounts a corresponding to each thickness of the paper Q and each material of paper Q may also be designed to be stored in the EEPROM 15. As long as the correction amount α is designed to be switched according to the material, it is possible to suppress an effect of a slight slip to occur depending on the material at the time when the paper Q is taken in through the nip portion PN on the positional accuracy and to perform the head poke of the paper Q further highly accurately. Besides, it is also possible to design so that simply the correction amount α corresponding to each type of the paper Q may be stored in the EEPROM 15.

Further, the skew correction can be performed not only in a state of the transporting roller 64 being made to rotate reversely but also in a state of the transporting roller 64 being stopped. Besides, it is possible to apply the present invention also to an electronic apparatus other than the printer apparatus 1 as long as the electronic apparatus is associated with feeding of a sheet such as a paper. Besides, the correction of the target rotation amount RT by the correction amount α according to the type (thickness, material, and so on) of the paper can also be omitted.

Finally, the correspondence relationship between terms will be explained. The paper feeding roller 62 is one example of a first roller, the transporting roller 64 is one example of a second roller, and the pinch roller 65 is one example of a third roller. Further, the processings in S110, S140, and S170 that the CPU 11 executes, the processings in S210 and S450 that the PF motor control section 35 executes, and so on are examples of processings to be achieved by a control section.

The processings in S220, S310 to S350, and S410 to S430 that the PF motor control section 35 executes, the processing in S130 that the CPU 11 executes, and the like are examples of processings to be achieved by an obtaining section, and the processings in S440 and S445 that the PF motor control section 35 executes are examples of processings to be achieved by a target setting section. Further, the processing achieved by the recording head 21 and the processing in S160 that the CPU 11 executes are examples of processings to be achieved by an image forming apparatus.

What is claimed is:

1. A sheet feeding device configured to feed a sheet along a predetermined feeding path, comprising:

a feeding mechanism having a first roller and a second roller provided downstream in the feeding path from the first roller and configured to feed the sheet by rotations of the first and second rollers, wherein the sheet is one of a plurality of types of sheets;

a control section configured to control the rotations of the first and second rollers, the control section executing a butting control in which the first roller is made to rotate forwardly in a state of the second roller being stopped or made to rotate reversely, to thereby feed the sheet from the first roller so as to butt against the second roller at an intake position of the second roller, and then executing an intake feeding control in which the second roller is made to rotate forwardly, to thereby feed the sheet downstream in the feeding path from the intake position;

an obtaining section configured to obtain information indicating a rotation amount of the second roller by a rotation phenomenon of the second roller which occurs in a period after the butting control to the start of the intake feeding control, and to obtain information indicating a correction amount corresponding to the type of sheet to be fed to the intake position; and a target setting section configured to set a target rotation amount, which is a rotation amount of the second roller that should be achieved in the intake feeding control, to an amount corrected from a standard target rotation amount for the rotation amount and the correction amount indicated by the information obtained by the obtaining section, wherein in the intake feeding control, the control section is configured to control the second roller to stop the rotation of the second roller at a timing at which the second roller has rotated for the target rotation amount since the start of the intake feeding control, so that the sheet stops at a position at which the sheet has been fed downstream in the feeding path from the intake position only for a distance corresponding to the standard target rotation amount.

2. The sheet feeding device according to claim 1, wherein the control section is configured to rotate the first roller forwardly in a state of making the second roller rotate reversely, to thereby execute the butting control, and the obtaining section, as the information indicating the rotation amount, obtains information indicating a rotation amount of the second roller by a rotation phenomenon of the second roller which occurs under a condition that a rotation direction of the second roller is switched from a reverse rotation direction to a forward rotation direction after the butting control is finished.

3. The sheet feeding device according to claim 1, wherein the obtaining section is configured to measure a difference in rotation position of the second roller before and after switching from the butting control to the intake feeding control, and configured to obtain the difference in the rotation position before and after the switching as the information indicating the rotation amount.

4. The sheet feeding device according to claim 1, wherein the obtaining section includes a storage section configured to store the correction amount therein for each of the plurality of types of the sheets, and the obtaining section is configured to specify the type of the sheet to be fed to the intake position from the first roller and to obtain the correction amount corresponding to the specified type of the sheet from the storage section.

5. The sheet feeding device according to claim 4, wherein the plurality of types of the sheets differ in thickness from one another, and the storage section is configured to store the correction amount therein for each thickness of the plurality of types of the sheets.

6. The sheet feeding device according to claim 1, wherein the feeding mechanism is configured to:

include a single motor and a power transmission mechanism to the first and second rollers;

transmit power generated from the single motor to the first and second rollers through the power transmission mechanism to rotationally drive the first and second rollers; and switch a power transmission system from the motor to the first and second rollers, from a power transmission system for the butting control of the power transmission mechanism to a power transmission system for the intake feeding control of the power transmission mechanism, in switching from the butting control to the intake feeding control.

7. The sheet feeding device according to claim 6, wherein the power transmission mechanism includes, as the power transmission system from the motor to the first and second rollers, a first power transmission system for transmitting the power generated from the motor to the first and second rollers so that the first roller rotates forwardly and the second roller rotates reversely, and a second power transmission system for transmitting the power generated from the motor only to the second so that the second roller rotates forwardly, in the butting control, the power transmission mechanism is configured to transmit the power from the motor to the first and second rollers through the first power transmission system as the power transmission system for the butting control, and in the intake feeding control, the power transmission mechanism is configured to transmit the power from the motor to the second roller through the second power transmission system as the power transmission system for the intake feeding control.

8. The sheet feeding device according to claim 1, wherein the feeding mechanism includes a third roller configured to make contact with the second roller, and the control section is configured to rotate the second roller to take in the sheet between the second roller and the third roller and then to feed the sheet downstream in the feeding path in a state of the sheet being sandwiched between the second roller and the third roller.

9. The sheet feeding device according to claim 1, wherein in a case that a width, of the sheet to be fed to the intake position, in a direction perpendicular to a feeding direction is equal to or larger than a predetermined size, the target setting section is configured to set the target rotation amount to the amount corrected from the standard target rotation amount, and in a case that the width of the sheet is smaller than the predetermined size, the target setting section is configured to set the target rotation amount to the standard target rotation amount.

10. An image forming system comprising:

the sheet feeding device as defined in claim 1; and an image forming apparatus configured to form an image on the sheet fed by the sheet feeding device, wherein the control section is configured to perform the intake feeding control of the sheet so that a starting point of an image forming target area on the sheet is fed to an image forming position, on a feeding path, at which the image forming apparatus form the image on the sheet, based on the target rotation amount, the control section is configured to control the rotation of the second roller to intermittently feed the sheet for each predetermined amount after ending the intake feeding control, and the image forming apparatus is configured to form the image on the sheet every time the sheet is fed intermittently by the controls of the control section, and to form the image on the image forming target area of the sheet.

11. A sheet feeding device configured to feed a sheet along a predetermined feeding path, comprising:

a feeding mechanism having a first roller and a second roller provided downstream in the feeding path from the first roller and configured to feed the sheet by rotations of the first and second rollers;

a control section configured to control the rotations of the first and second rollers, the control section executing a butting control in which the first roller is made to rotate forwardly in a state of the second roller being stopped or made to rotate reversely, to thereby feed the sheet from the first roller so as to butt against the second roller at an intake position of the second roller, and then executing an intake feeding control in which the second roller is made to rotate forwardly, to thereby feed the sheet downstream in the feeding path from the intake position;

an obtaining section configured to obtain information indicating a rotation amount of the second roller by a rotation phenomenon of the second roller which occurs in a period after the butting control to the start of the intake feeding control; and a target setting section configured to set a target rotation amount, which is a rotation amount of the second roller that should be achieved in the intake feeding control, to an amount corrected from a standard target rotation amount for the rotation amount indicated by the information obtained by the obtaining section, wherein in a case that a width, of the sheet to be fed to the intake position, in a direction perpendicular to a feeding direction is equal to or larger than a predetermined size, the target setting section is configured to set the target rotation amount to the amount corrected from the standard target rotation amount, wherein in a case that the width of the sheet is smaller than the predetermined size, the target setting section is configured to set the target rotation amount to the standard target rotation amount, and wherein in the intake feeding control, the control section is configured to control the second roller to stop the rotation of the second roller at a timing at which the second roller has rotated for the target rotation amount since the start of the intake feeding control, so that the sheet stops at a position at which the sheet has been fed downstream in the feeding path from the intake position only for a distance corresponding to the standard target rotation amount.

12. The sheet feeding device according to claim 11, wherein the sheet is one of a plurality of types of sheets, the obtaining section is configured to further obtain a correction amount corresponding to the type of the sheet to be fed to the intake position, and the target setting section is configured to set the target rotation amount to an amount corrected from the standard target rotation amount for the rotation amount and the correction amount.

* * * * *